US009572423B1

(12) United States Patent
Stuart

(10) Patent No.: US 9,572,423 B1
(45) Date of Patent: Feb. 21, 2017

(54) COMBINATION STRUCTURE

(71) Applicant: Earl S. Stuart, Boyceville, WI (US)

(72) Inventor: Earl S. Stuart, Boyceville, WI (US)

( * ) Notice: Subject to any disclaimer, the term of this patent is extended or adjusted under 35 U.S.C. 154(b) by 0 days.

(21) Appl. No.: 14/856,641

(22) Filed: Sep. 17, 2015

Related U.S. Application Data

(60) Provisional application No. 62/053,409, filed on Sep. 22, 2014.

(51) Int. Cl.

| | |
|---|---|
| ***A63H 33/00*** | (2006.01) |
| ***A47B 13/08*** | (2006.01) |
| ***A63H 3/52*** | (2006.01) |
| ***A47B 25/00*** | (2006.01) |

(52) U.S. Cl.
CPC ..... *A47B 13/081* (2013.01); *A47B 25/00* (2013.01); *A63H 3/52* (2013.01)

(58) Field of Classification Search
USPC ..... 446/71, 75, 108, 109, 111, 112, 115, 116,446/479, 482, 487, 488
See application file for complete search history.

(56) References Cited

U.S. PATENT DOCUMENTS

| | | | | | |
|---|---|---|---|---|---|
| 992,337 | A * | 5/1911 | Butler | A63H 33/00 | 446/110 |
| 1,131,894 | A * | 3/1915 | Baker | A63H 3/52 | 446/482 |
| 2,535,792 | A | 12/1950 | Goodale | | |
| 4,212,130 | A * | 7/1980 | Walker | A63H 33/103 | 446/111 |
| 4,343,117 | A * | 8/1982 | Shemitz | A47B 47/0075 | 211/118 |
| 4,765,006 | A * | 8/1988 | Jackson | A47C 21/00 | 446/478 |
| 5,085,608 | A * | 2/1992 | Turner | A47B 85/00 | 312/314 |
| 5,330,379 | A * | 7/1994 | Roh | A47D 1/006 | 297/440.14 |
| 5,718,089 | A * | 2/1998 | Dakin | A63H 33/008 | 446/110 |
| 5,768,722 | A | 6/1998 | Olson et al. | | |
| 6,500,007 | B2 * | 12/2002 | Pupulin | A63H 33/10 | 273/157 R |
| 6,607,421 | B1 * | 8/2003 | Rossi | A63H 3/52 | 446/478 |
| 6,728,981 | B1 * | 5/2004 | Gutierrez | A47D 11/005 | 446/479 |

(Continued)

FOREIGN PATENT DOCUMENTS

DE 202007005530 U1 8/2007

OTHER PUBLICATIONS

Pacific Play Tents Cottage Playhouse. Product listing [online]. Hayneedle.com 2015 [Published on Nov. 7, 2013]. Retrieved from the Internet:< http://www.hayneedle.com/product/pacificplaytentscottageplayhouse.cfm>.

(Continued)

*Primary Examiner* — Kurt Fernstrom
(74) *Attorney, Agent, or Firm* — Riba C Montgomery; Montgomery Patent & Design, LP.

(57) ABSTRACT

A modular structure includes a base assembly; and a roof assembly coupled to the base assembly, wherein the structure is selectively reconfigurable between a table configuration and a playhouse configuration.

17 Claims, 12 Drawing Sheets

(56) References Cited

U.S. PATENT DOCUMENTS

| | | | | |
|---|---|---|---|---|
| 7,552,563 | B2 * | 6/2009 | Becker | B42D 15/042 229/108 |
| 8,245,649 | B1 * | 8/2012 | Ratliff | A47D 3/00 108/156 |
| 8,316,781 | B1 * | 11/2012 | Majors | 108/158.12 |
| 8,777,304 | B2 * | 7/2014 | Dixon | A47D 11/005 297/1 |
| 2004/0166765 | A1 | 8/2004 | Martin et al. | |
| 2011/0266846 | A1 | 11/2011 | Dixon | |
| 2012/0304389 | A1 * | 12/2012 | Ranck | A63H 33/008 5/655.9 |

OTHER PUBLICATIONS

Tents/Tables/Chairs. Product listing [online]. Jumping Bean Party Rental 2015 [Published on Nov. 18, 2012]. Retrieved from the Internet:< http://jumpingbeanpartyrental.com/bounce-house-rentals/tentstableschairs/>.

* cited by examiner

COMBINATION STRUCTURE

RELATED APPLICATIONS

The present invention is a continuation-in-part of, was first described in, and claims the benefit of U.S. Provisional Application No. 62/053,409, filed Sep. 22, 2014, the entire disclosures of which are incorporated herein by reference.

FIELD OF THE INVENTION

The present invention relates generally to structures and, more particularly, to a plurality of structural members providing selective adaptation into various forms such as a table, a playhouse, or a tent base.

BACKGROUND OF THE INVENTION

Building or crafting things is a rewarding way to provide services and recreational items. Building items that have a way of transforming into other configurations using the same pieces and parts is economically feasible and elegant in design. Playhouses are such structures, in that a highly effective, structurally sound, and elegantly designed configuration can become tiresome after some time. If there is a way to utilize the same features to build and craft an entirely new structure, particularly by children who can also learn some labor, engineering, and architecture functions, is a bonus.

SUMMARY OF THE INVENTION

The inventor has recognized the aforementioned inherent problems and lack in the art and observed that there is a need for a convertible and modular structure that can be converted into other configurations. The development of the present invention, which will be described in greater detail herein, substantially departs from conventional solutions to fulfill this need.

In one (1) embodiment, the disclosed modular structure includes: a base assembly; and a roof assembly coupled to the base assembly, wherein the structure is selectively reconfigurable between a table configuration and a playhouse configuration.

In another embodiment, the disclosed modular structure includes: a base assembly; and a roof assembly removably connected to the base assembly, wherein the roof assembly is reconfigurable between an inverted "V"-shape to selectively reconfigure the structure in a playhouse configuration and a flat configuration to selectively reconfigure the structure in a table configuration.

In yet another embodiment, the disclosed modular structure selectively reconfigurable between a table configuration and a playhouse configuration includes: a base assembly including: a first end panel including a pair of first end panel grooves; a first entry aperture; a first end panel slot; a pair of first sliding doors disposed within the first end panel slot, wherein the first sliding doors are movable to cover the first entry aperture; and a pair of first hanging apertures; a second end panel opposite the first end panel, the second end panel including: a pair of second end panel grooves; a second entry aperture; a second end panel slot; a pair of second sliding doors disposed within the second end panel slot, wherein the second sliding doors are movable to cover the second entry aperture; and a pair of second hanging apertures; a first side panel interconnected between the first end panel and the second end panel; a first seat connected to the first side panel, wherein the first seat is exposed when the structure is in the table configuration; a second side panel interconnected between the first end panel and the second end panel opposite the first side panel, the second side panel comprising a cover slot; and a second seat connected to the second side panel, wherein the second seat is exposed when in the structure is in the table configuration.

The structure further includes a first peak panel including: a pair of first peak panel tabs, wherein the first peak panel tabs matingly engage the first end panel grooves to connect the first peak panel to the first end panel when the structure is in the playhouse configuration; a pair of first roof grooves; and a pair of first hanging posts, wherein the first hanging apertures receive the first hanging posts to hang the first peak panel on the first end panel when the structure is in the table configuration; and a second peak panel including: a pair of second peak panel tabs, wherein the second peak panel tabs matingly engage the second end panel grooves to connect the second peak panel to the second end panel when the structure is in the playhouse configuration; a pair of second roof grooves; and a pair of second hanging posts, wherein the second hanging apertures receive the second hanging posts to hang the second peak panel of the second end panel when the structure is in the table configuration.

The structure further includes a roof assembly including: a first roof panel; a fourth roof panel hingedly connected to the first roof panel; a third roof panel hingedly connected to the fourth roof panel opposite the first roof panel; a second roof panel hingedly connected to the third roof panel opposite the fourth roof panel; and four roof tabs connected to the third roof panel and the fourth roof panel, wherein the third roof panel and the fourth roof panel are folded at an angle relative to each other, the first roof panel is folded coplanar with the fourth roof panel, and the second roof panel is folded coplanar with the third roof panel to configure the roof assembly into an inverted "V"-shape when the structure is in the playhouse configuration, wherein the roof tabs matingly engage the first roof grooves and the second roof grooves to connect the roof assembly to the first peak panel and the second peak panel when the structure is in the playhouse configuration, wherein the first roof panel is folded onto the first roof panel and the second roof panel is folded onto the third roof panel to configure the roof assembly into a flat shape when the structure is in the table configuration, and wherein the roof tabs matingly engage the first end panel grooves and the second end panel grooves to connect the roof assembly to the first end panel and the second end panel when the structure is in the table configuration.

The structure further includes an enclosure coupled to an interior surface of the second side panel and the second seat. The structure further includes a winding assembly disposed within the enclosure and connected to the interior surface of the second side panel, the winding assembly including: a spool bracket connected to the interior surface of the second side panel; a spool rotatably connected to the spool bracket; and a crank connected to the spool.

The structure further includes a cover connected to the spool and extendable through the cover slot, the cover comprising a connected to a free end of the cover and located outside the cover slot, wherein the cover extends over the roof assembly when the structure is in the playhouse configuration, and wherein the cover is wound around the spool when the structure is in the table configuration.

The structure further includes a pair of hook brackets connected to an exterior surface of the first side panel opposite the cover slot, wherein the pole engages the hook brackets to secure the cover over the roof assembly.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
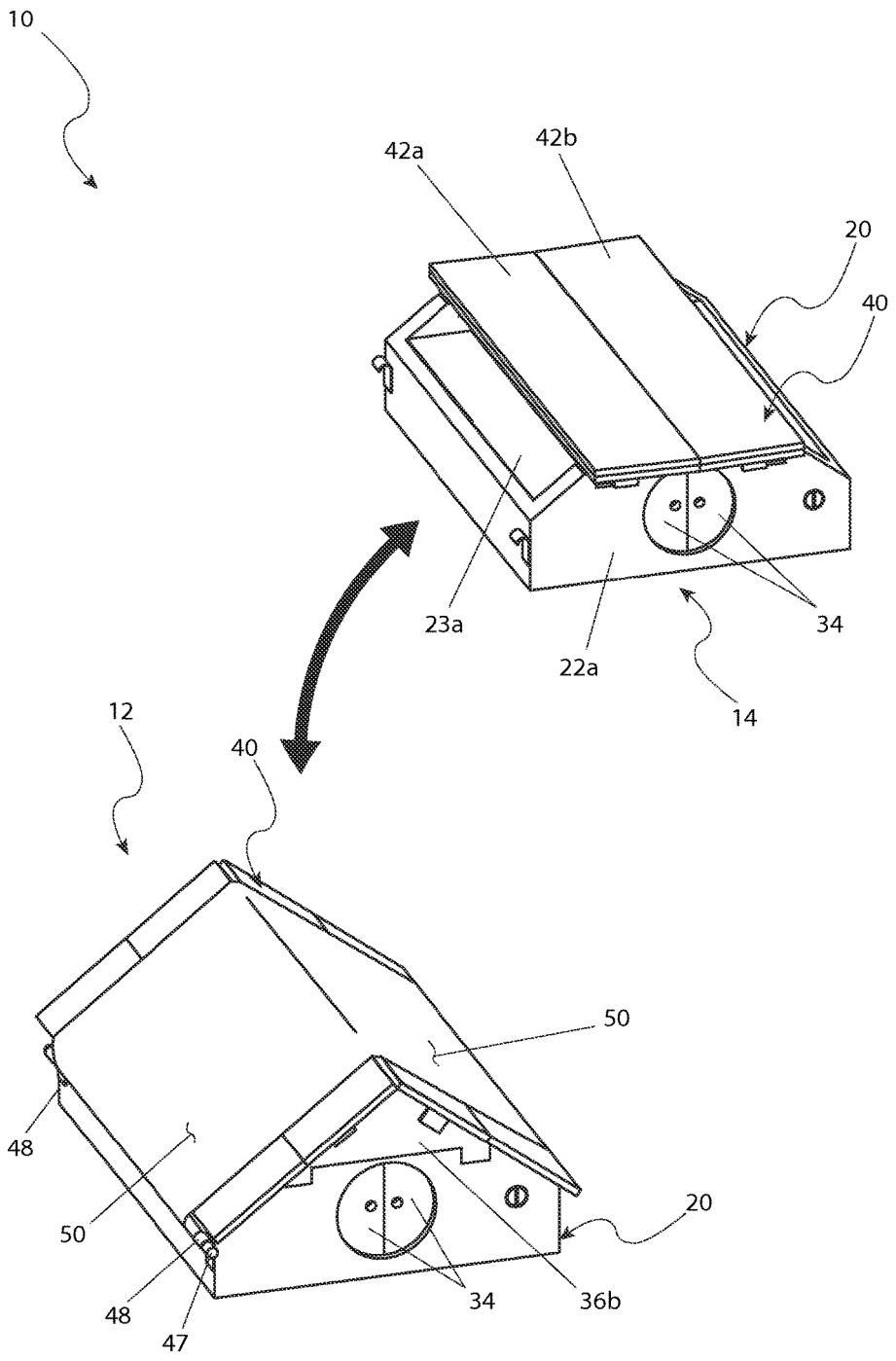
FIG. 1 provides views of a combination structure 10 depicting perspective views of a playhouse configuration 12 and a table configuration 14, according to a preferred embodiment of the present invention.

10 combination structure
12 playhouse configuration
14 table configuration
20 base assembly
22*a* first end panel
22*b* first side panel
22*c* second end panel
22*d* second side panel
23*a* first seat
23*b* second seat
24 floor panel
27 entry aperture
28*a* first end panel slot
28*b* second end panel slot
30 end panel groove
32*a* hanging aperture
32*b* hanging post
34 sliding door
35 door aperture
36*a* first peak panel
36*b* second peak panel
37 roof groove
38 peak panel tab
40 roof assembly
42*a* first roof panel
42*b* second roof panel
42*c* third roof panel
42*d* fourth roof panel
44 roof tab
46*a* first hinge
46*b* second hinge
46*c* third hinge
47 pole
48 hook bracket
50 cover
60 winding assembly
62 hand crank
64 enclosure
65 cover slot
67*a* spool
67*b* spool bracket
68 axle

DETAILED DESCRIPTION OF THE PREFERRED EMBODIMENT

In accordance with the invention, the best mode is presented in terms of a one or more of the disclosed embodiments, herein depicted within FIGS. 1 through 12. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, singular terms such as "a", "an", and "the" do not denote a limitation of quantity, but rather denote the presence of at least one, as well as a plurality of, the referenced items, unless the context clearly indicates otherwise.

As used herein, terms such as "first", "second", "third", etc. are used as labels to describe various elements, features, and/or components, and are not intended to impose ordinal, positional, or hierarchical requirements on the referenced items, unless other indicated. For example, such terms may be used to distinguish one element from another element.

As used herein, relative terms such as "front", "rear", "left", "right", "top", "bottom", "below", "above", "upper", "lower", "horizontal", or "vertical" are used to describe a relationship of one element, feature and/or region to another element, feature and/or region as illustrated in the figures.

Referring to FIGS. 1-12, a combination structure (herein described as the "system") 10 is disclosed, where like reference numerals represent similar or like parts. Generally, the disclosed system 10 provides a plurality of structural members capable of being selectively configured to form a picnic-like table 14 (also referred to herein as a table configuration 14), a playhouse 12 (also referred to herein as a playhouse configuration 12), or may also be utilized as a base for a tent.

Referring now to FIG. 1, views of the system 10 depicting perspective views of the playhouse configuration 12 and the table configuration 14, according to a preferred embodiment of the present invention, are disclosed. The system 10 includes a base assembly 20, a first peak panel 36*a*, a second peak panel 36*b*, and a roof assembly 40. The base assembly 20 provides a unitary open-topped rectangular structure including a first end panel 22*a*, a first side panel 22*b*, a second end panel 22*c*, a second side panel 22*d*, and a floor panel 24.

Figure 7:
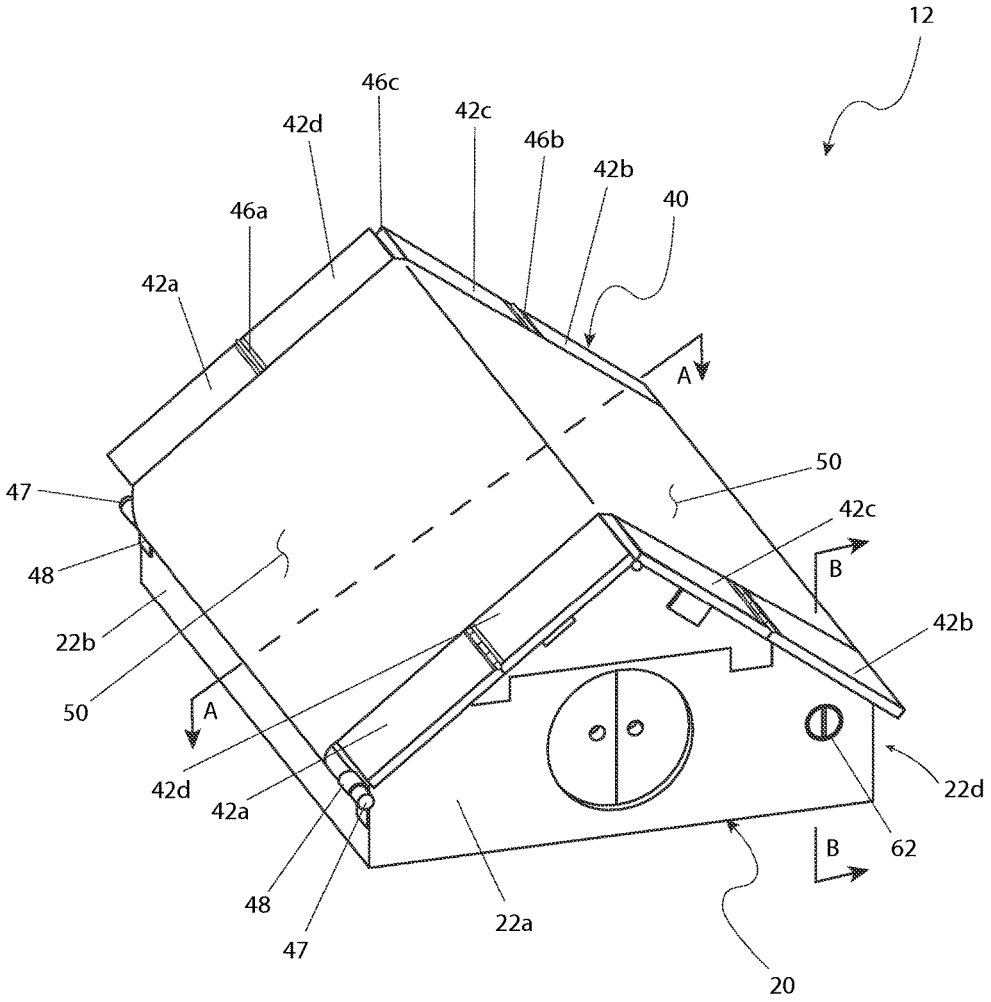
FIG. 7 is a perspective view of the playhouse configuration 12 depicting installation of a protective cover portion 50, according to a preferred embodiment of the present invention.

When arranged in the "peaked" playhouse configuration 12, the roof assembly 40 is unfolded and expanded into an inverted "V"-shape to cover the entire base assembly 20 and may be also be shielded from the elements by deploying a cover 50 over the roof assembly 40 (see FIG. 7). When in the flat or table configuration 14, the roof assembly 40 is folded upon itself to form a narrowed table-top surface, thus exposing bench-style seating 23*a*, 23*b* along opposing long sides of the base assembly 20. The seats 23*a*, 23*b* are integrated into the side panels 22*b*, 22*d* and span a distance between the end panels 22*a*, 22*c*.

Figure 4:
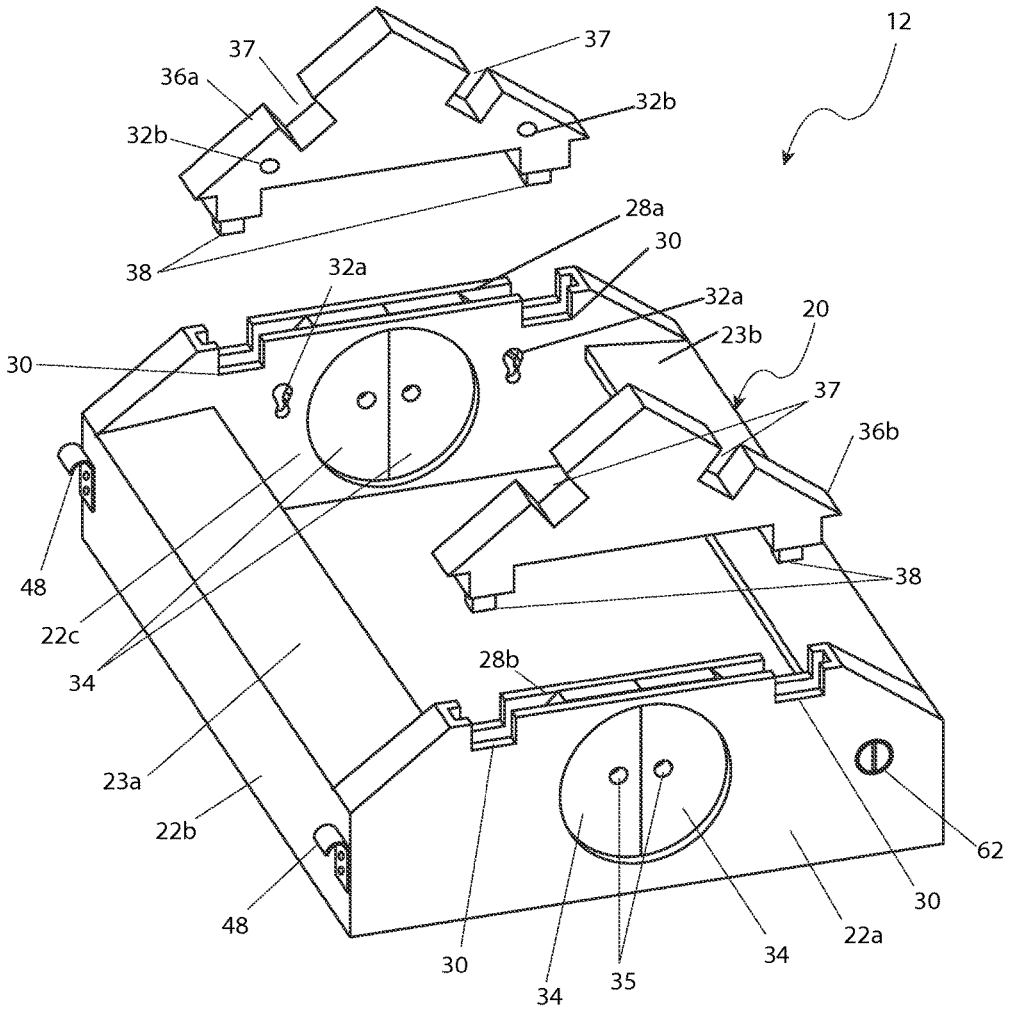
FIG. 4 is another perspective view of the playhouse configuration 12 of the combination structure 10 depicting installation of peak panel portions 36*a*, 36*b*, according to a preferred embodiment of the present invention.
Figure 5:
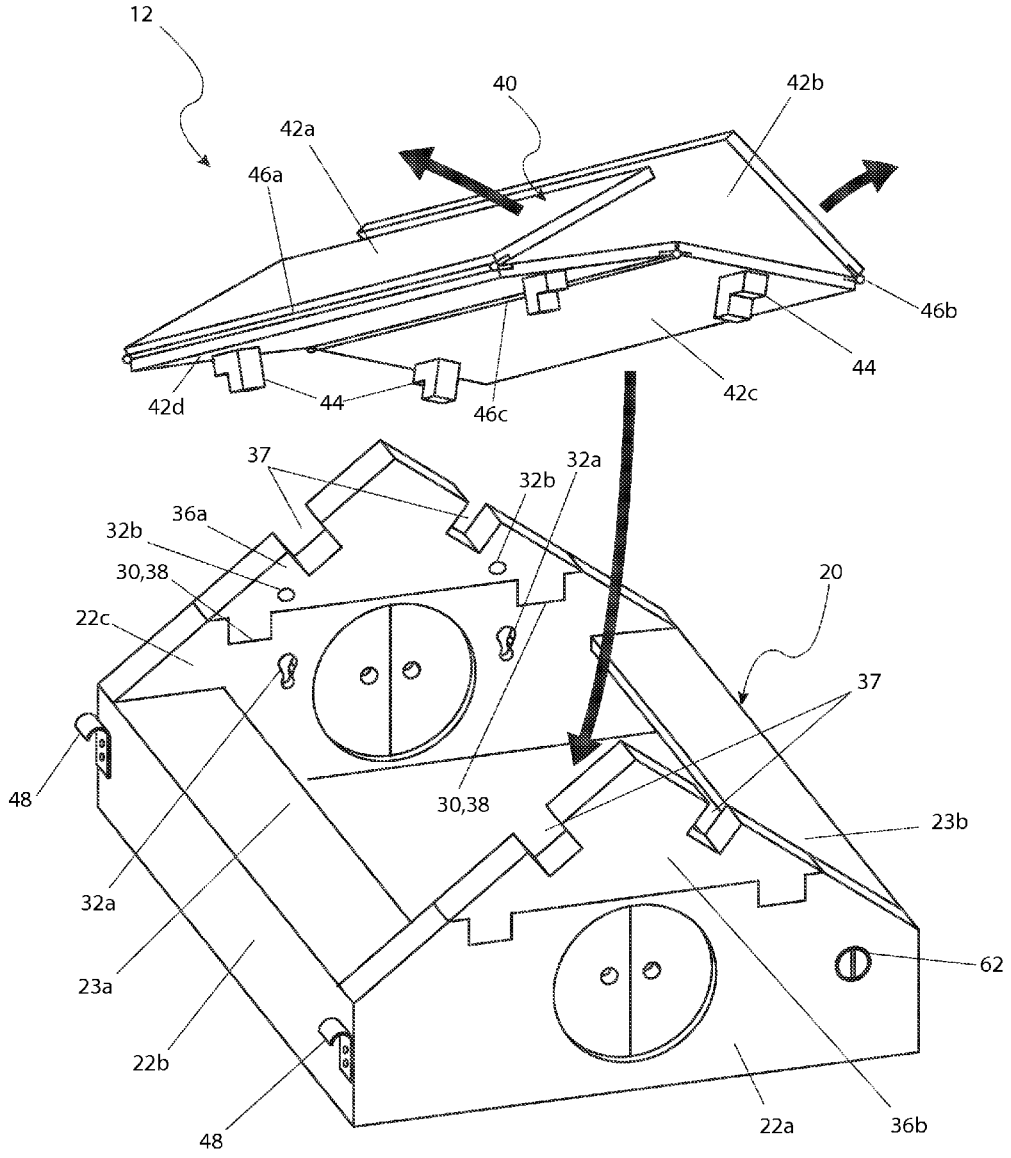
FIG. 5 is yet another perspective view of the playhouse configuration 12 of the combination structure 10 depicting installation of a roof assembly portion 40, according to a preferred embodiment of the present invention.

Referring to FIGS. 4 and 5, the portions of the system 10 also provide a plurality of integral interlocking grooves 37, 30 and tabs 38, 44 which enable easy attachment of the roof assembly 40 in either a flat or peaked form.

Referring to FIGS. 1-6, the portions of the system 10 are envisioned being made out of plastic, wood, or other durable weather resistant materials, and are further envisioned being provided in various colors and patterns, as well as various overall sizes. It is understood that the system 10 is not limited to the embodiments illustrated here, but may provide other configurations and methods of usage, for example, utilizing the base assembly 20 as a tent base or storage device, and as such should not be interpreted as a limitation of scope.

Figure 2:
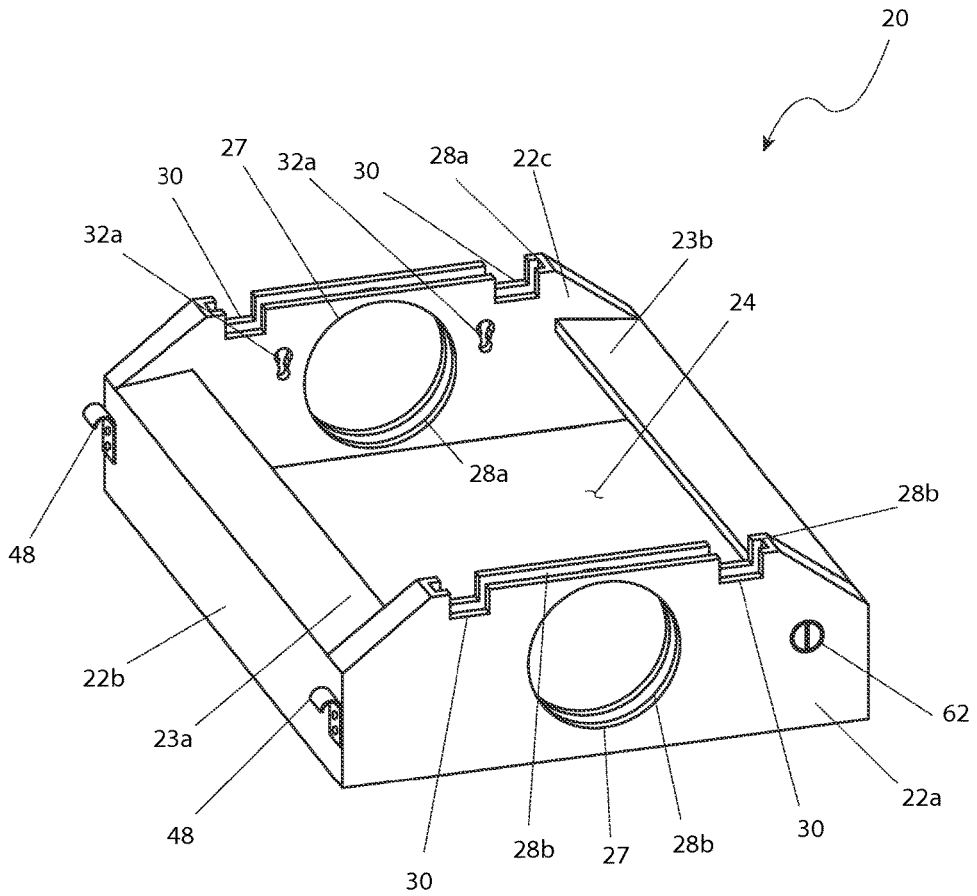
FIG. 2 is a perspective view of a base assembly portion 20 of the combination structure 10, according to a preferred embodiment of the present invention.

Referring now to FIG. 2, a perspective view of the base assembly 20 of the system 10, according to a preferred embodiment of the present invention, is disclosed. The base assembly 20 further provides various enhancements including a pair of seats 23*a*, 23*b*, a pair of entry apertures 27, a pair of hook brackets 48, a first end panel slot 28*a*, a second end panel slot 28*b*, and two (2) pairs of end panel grooves 30.

Each entry aperture 27 provides a large round or oval-shaped opening centered within each end panel 22*a*, 22*c* to enable users to enter and exit the base assembly 20 when the system 10 is arranged in the playhouse configuration 12. The hook brackets 48 are mounted to the first side panel 22*b* along an external surface to provide a means for securing a distal end of the cover 50 as it is deployed and extended over the roof assembly 40 (see FIG. 7). The end panel slots 28*a*, 28*b* are located along top surfaces of respective first 22*a* and second 22*c* end panels of the base assembly 20, and protrude into each end panel 22*a*, 22*c* down to the floor panel 24, forming hollow wall structures. The end panel slots 28*a*, 28*b* enable vertical insertion of the sliding doors 34 within (see FIGS. 3 and 4). Finally, the end panel grooves 30 extend across top surfaces of the end panels 22*a*, 22*c*, being perpendicular to the end panel slots 28*a*, 28*b*. The end panel grooves 30 provide a means to interlock and secure respective first peak panel 36*a* and second peak panel 36*b* to the end panels 22*a*, 22*c* when arranging the system 10 in the playhouse configuration 14 (see FIGS. 4 and 5).

Figure 3:
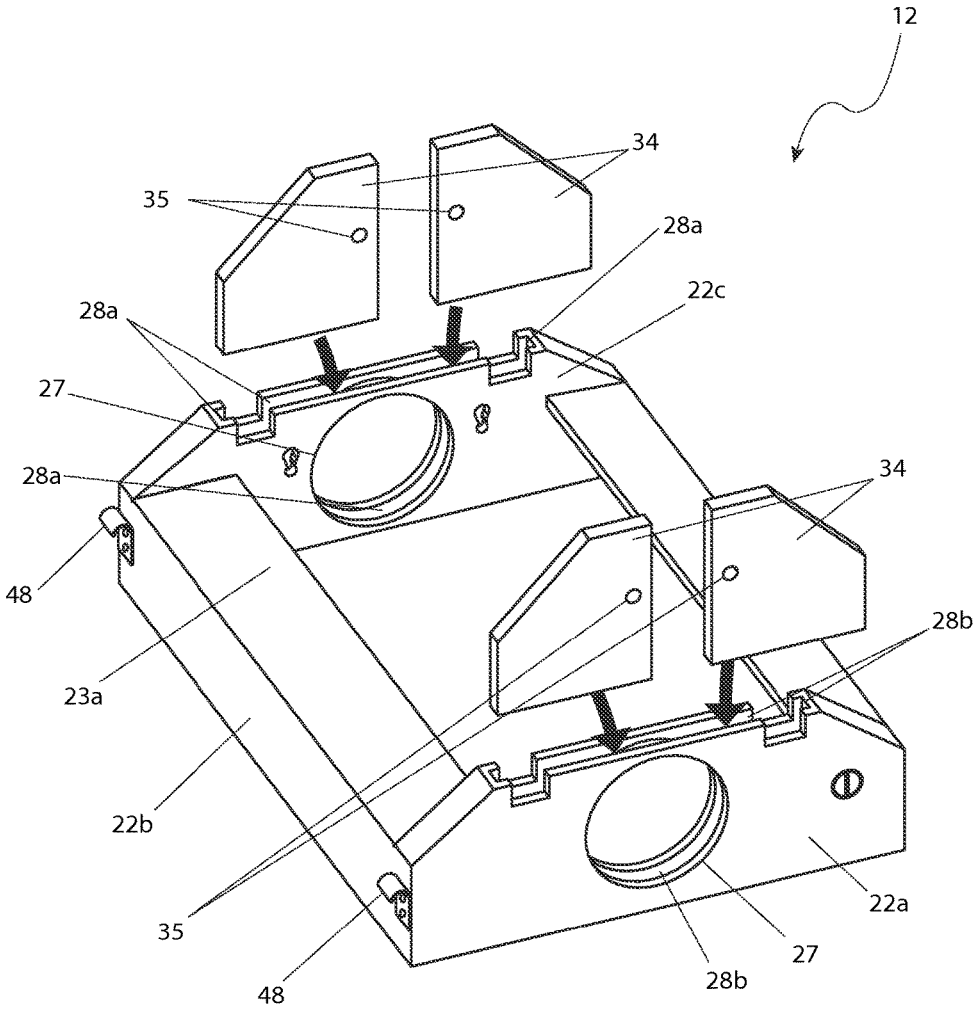
FIG. 3 is a perspective view of the playhouse configuration 12 depicting installation of sliding door portions 34, according to a preferred embodiment of the present invention.

Referring now to FIGS. 3 through 7, perspective views depicting assembly and arrangement of the system 10 into the playhouse configuration 12, according to a preferred embodiment of the present invention, is disclosed. The sliding doors 34 are vertically inserted into each end panel slots 28*a*, 28*b* and subsequently motioned horizontally across the entry apertures 27 to selectively open or close the entry apertures 27 as seen in FIGS. 3 and 4. The entry apertures 27 are envisioned to provide children a ground-level means to enter the playhouse configuration 12. In a preferred embodiment, each entry aperture 27 can accommodate a pair of sliding doors 34 installed therein.

Figure 6:
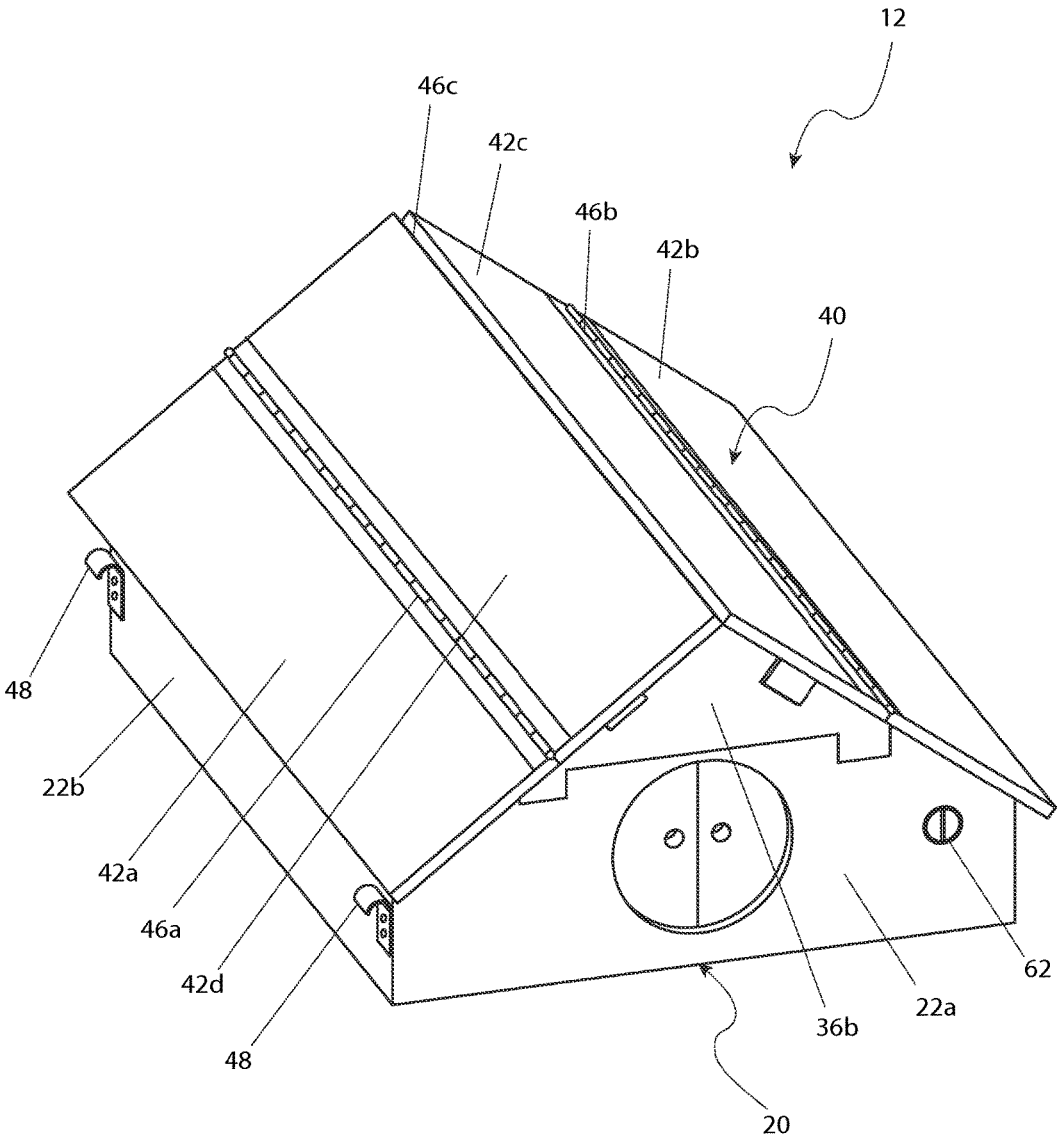
FIG. 6 is yet another perspective view of the playhouse configuration 12 of the combination structure 10 depicting an assembled state, according to a preferred embodiment of the present invention.

As illustrated in FIGS. 4, 5 and 6, the first peak panel 36*a* and second 36*b* peak panel are affixed to top portions of respective end panels 22*a*, 22*c*, combining to form inverted "V"-shaped profiles onto which the roof assembly 40 is to be placed. The peak panels 36*a*, 36*b* are removably attached to the end panels 22*a*, 22*c* via engagement of respective "T"-shaped peak panel tabs 38 and correspondingly shaped end panel grooves 30. The peak panel tabs 38 and end panel grooves 30 are envisioned to be molded or otherwise formed integral features. Engagement of the peak panel tabs 38 and the end panel grooves 30 results in a coplanar relationship between inclined surfaces of the end panels 22*a*, 22*c* and the first 36*a* and second 36*b* peak panels.

The roof assembly 40 provides a bi-folding assembly of four (4) rectangular panels joined along edge portions using hinges 46*a*, 46*b*, 46*c*, and being arranged in a parallel manner as seen in FIG. 5. The roof assembly 40 includes a first roof panel 42*a*, a second roof panel 42*b*, a third roof panel 42*c*, and a fourth roof panel 42*d*. The first 42*a* and fourth 42*d* roof panels are joined along adjacent edge portions via a first hinge 46*a*. The second 42*b* and third 42*c* roof panels are joined along adjacent edge portions via a second hinge 46*b*. The third 42*c* and fourth 42*d* roof panels are joined along adjacent edge portions via a third hinge 46*c*, opposite the first hinge 46*a* and second hinge 46*b*.

When in the playhouse configuration 12, as seen in FIG. 6, one (1) half of the roof assembly 40 including the adjacent first 42*a* and fourth 42*d* roof panels are pivoted about the first hinge 46*a* into a coplanar position. Likewise, the other half of the roof assembly 40 including the adjacent second 42*b* and third 42*c* roof panels, are pivoted about the second hinge 46*b* into a coplanar position. The half portions of the roof assembly 40 are then pivoted about the joining third hinge 46*c* to form an inverted "V"-shape enabling placement and attachment of the roof assembly 40 upon the subjacent end panels 22*a*, 22*c* and peak panels 36*a*, 36*b* in a parallel manner. The third 42*c* and fourth 42*d* roof panels each include a pair of integral roof tabs 44 along bottom surfaces which extend perpendicularly downward. The roof tabs 44 are "L"-shaped, sized, and shaped for removable insertion and engagement with correspondingly sized and shaped roof groove portions 37 of the peak panels 36*a*, 36*b*, being correspondingly positioned along top inclined surfaces.

Figure 9:
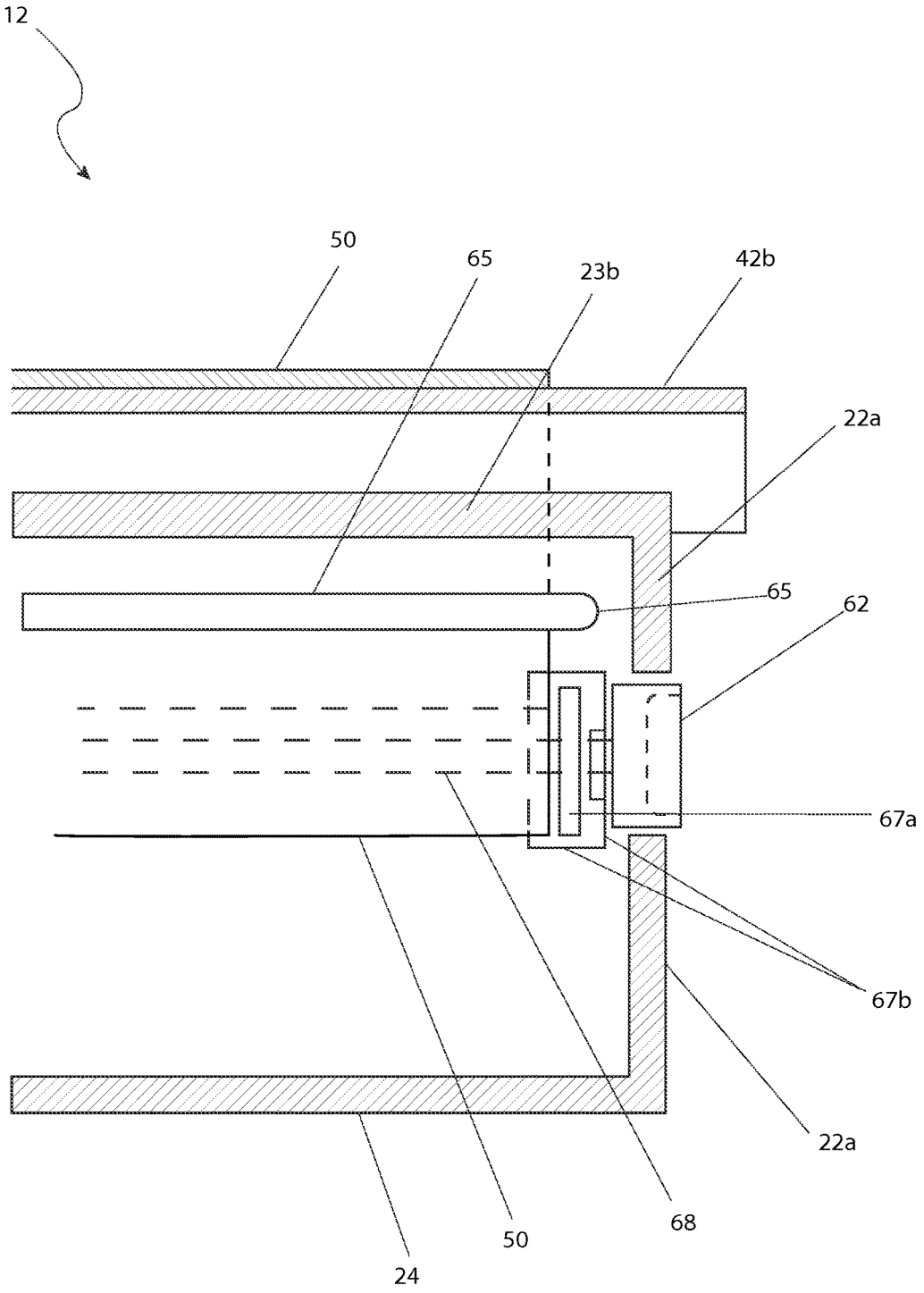
FIG. 9 is a sectional view of cover 50 and hand crank 62 portions taken along section line B-B (see FIG. 7), according to a preferred embodiment of the present invention.

Once the roof assembly 40 is placed upon the end panels 22*a*, 22*c* and peak panels 36*a*, 36*b*, a cover 50 may be deployed from the base assembly 20 to cover the roof assembly 40 to provide protection from weather elements such as rain, if desired (see FIGS. 7 and 9).

Figure 8:
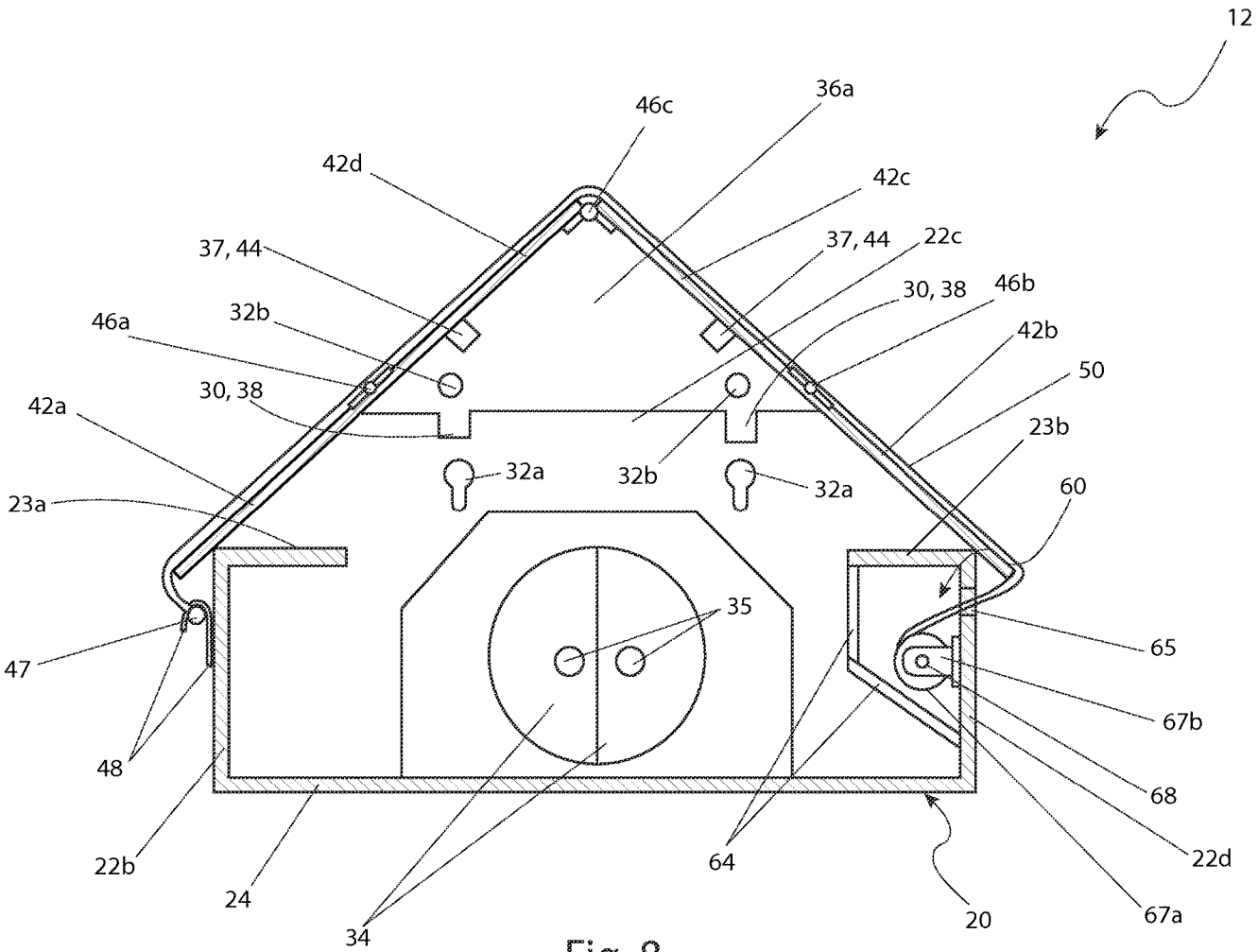
FIG. 8 is a sectional view of the playhouse configuration 12 taken along section line A-A (see FIG. 7), according to a preferred embodiment of the present invention.

Referring now to FIG. 8, a sectional view of the playhouse configuration 12 taken along section line A-A (see FIG. 7), according to a preferred embodiment of the present invention, is disclosed. The base assembly 20 includes an enclosure 64 preferably located beneath the second seat 23*b* which houses equipment to roll up, as well as deploy the cover 50 over the playhouse configuration 12, when desired. The cover 50 provides protection from the elements and is envisioned to be made of a weather-resistant textile material capable of repelling moisture such as canvas, vinyl, or the like. A proximal edge portion of the cover 50 is affixed and wound around an elongated spool 67*a* located within the enclosure 64, which extends the length of the second side panel 22*d*. The spool 67*a* is anchored at end portions to an inner surface of the second side panel 22*d* via respective spool brackets 67*b*. The spool 67*a* includes a central axle 68 having an integral hand crank 62 portion at one (1) end which extends through the first end panel 22*a* to provide external access to a user for manual winding of the cover 50 around the spool 67*a* following use (see FIG. 9). The distal end of the cover 50 is routed from within the enclosure 64 through a cover slot 65 formed across the second side panel 22*d*. The pole 47 is affixed to the distal edge portion of the cover 50 using sewing or equivalent means and extends across the distal edge thereof, and protrudes outward from the cover 50 at each end. The pole 47 provides a means to grasp and extend the cover 50 outwardly. When not in use, the cover 50 is rolled up with the distal edge of the cover 50 and the pole 47 resides along an external surface of the second side panel 22*d*.

To deploy the cover 50 over the playhouse configuration 12 of the system 10, the pole 47 can be grasped to pull the cover 50 outwardly through the cover slot 65 up over the roof assembly 40. The cover 50 can then be secured by attaching the protruding end portions of the pole 47 to correspondingly positioned hook brackets 48 mounted to the first side panel 22*b*. An embodiment of the hook brackets 48 is illustrated here being inverted "J"-shaped appendages which provide a snug secure fit around the protruding ends of the pole 47; however, other means to anchor the pole 47 may be used with equal benefit, and as such should not be interpreted as a limitation of scope.

Figure 12:
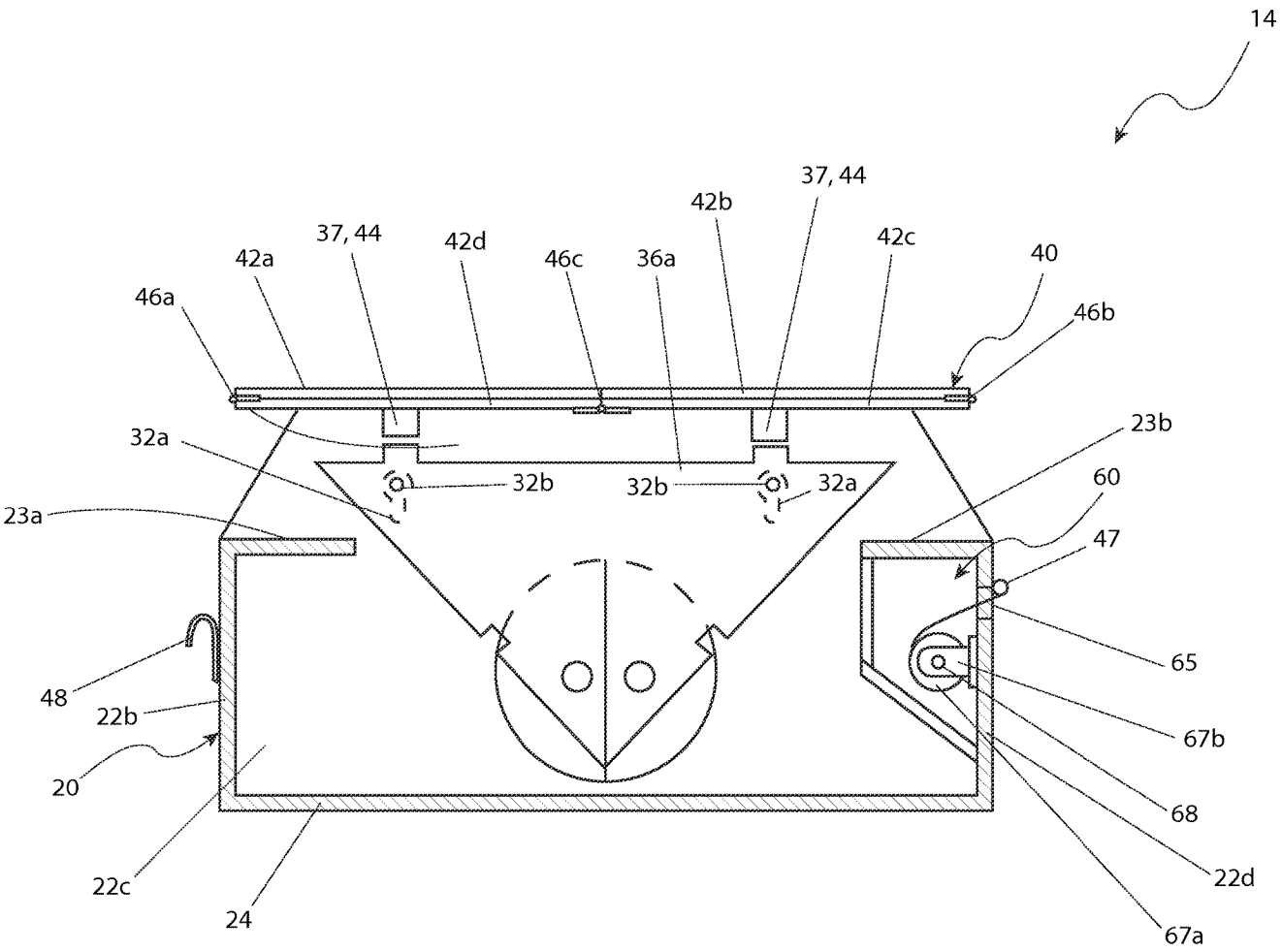

Following use, the cover 50 may be wound up by detaching end portions of the pole 47 from respective hook brackets 48 and rotating the hand crank 62 to retract the cover 50 through the cover aperture 65 and onto the spool 67*a* until the pole 47 is positioned against the second side panel 22*d* (see FIG. 12).

Figure 10:
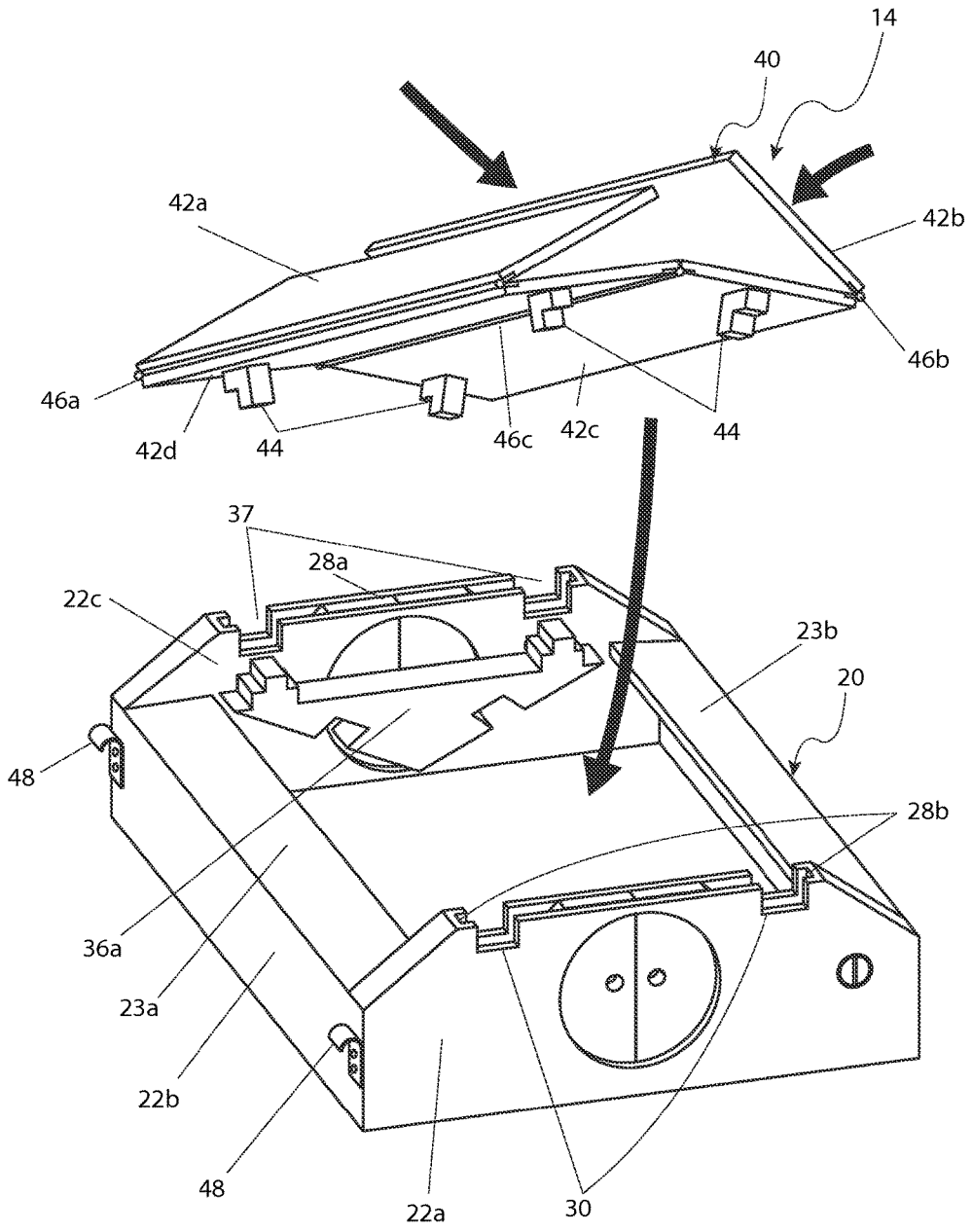
FIG. 10 is a perspective view of a table configuration 14 of the combination structure 10 depicting installation of a roof assembly portion 40, according to a preferred embodiment of the present invention.
Figure 11:
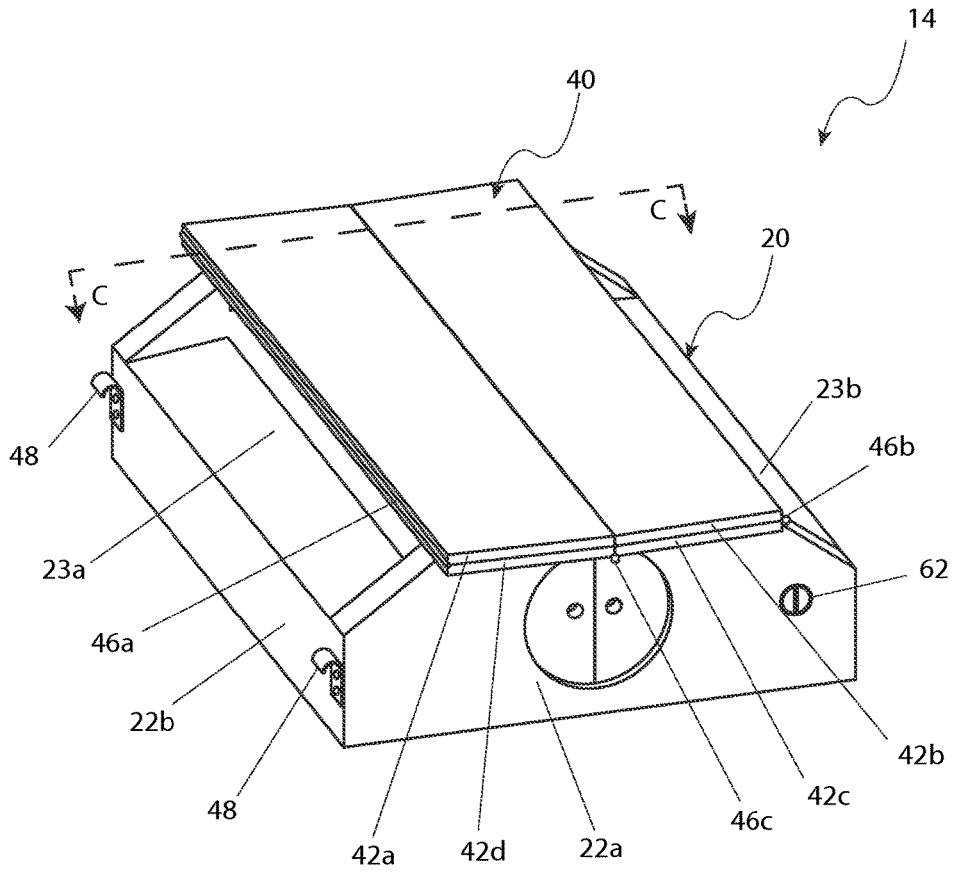
FIG. 11 is a perspective view of the table configuration 14 depicting an assembled state, according to a preferred embodiment of the present invention; and, FIG. 12 is a sectional view of the table configuration 14 taken along section line C-C (see FIG. 11), according to a preferred embodiment of the present invention

Referring now to FIGS. 10 through 12, perspective and section views depicting assembly and arrangement of the system 10 into the table configuration 14, according to a preferred embodiment of the present invention, are disclosed. The system 10 may be rearranged to receive and attach a flat configuration of the roof assembly 40 upon the end panels 22*a*, 22*c*, thereby providing a picnic-table-like arrangement including a table surface and opposing stationary bench-type seats 23*a*, 23*b*.

When converting the system 10 from the playhouse configuration 12, the system 10 may be prepared for adaptation by removing the roof assembly 40 and the peak panels 36*a*, 36*b*. The system 10 provides a means to discreetly hang and store the peak panels 26*a*, 26*b* along inwardly-facing surfaces of the end panels 22*a*, 22*c* during times when the system 10 is in the table configuration 14 as seen in FIG. 12. Removal of the peak panels 36*a*, 36*b* provides access to horizontal top surfaces of the end panels 22*a*, 22*c* and the roof groove portions 37 as seen in FIG. 10.

An embodiment of the end panels 22*a*, 22*c* and peak panels 36*a*, 36*b* are illustrated here including integrally-molded, or otherwise formed, engaging male and female features for hanging and storing the peak panels 36*a*, 36*b* including keyhole-shaped hanging apertures 32*a* and cylindrical hanging post portions 32*b*; however, other means of attaching the peak panels 36*a*, 36*b* to the end panels 22*a*, 22*c* may be utilized with equal benefit such as, but not limited to: utilizing an alternate hinged connection to the end panels 22*a*, 22*c* which could be pivoted inwardly, and similar means, without deviating from the teachings of the system 10, and as such should not be interpreted as a limitation of scope. In a preferred embodiment, the hanging apertures 32*a* are located on respective inner surface of each end panel 22*a*, 22*c*. In this embodiment, the post portions 32*b* are also located on inner surfaces of the peak panels 36*a*, 36*b*.

The opposing first 42*a* and second 42*b* roof panel portions of the roof assembly 40 would be folded over upon respective fourth 42*d* and third 42*c* roof panels to form a flat narrow embodiment of the roof assembly 40 which would provide a table top surface when placed upon the top surfaces of the end panels 22*a*, 22*c*. The reconfigured roof assembly 40 is to be coincidentally secured thereto the end panels 22*a*, 22*c* via engagement of the roof tabs 44 of the roof assembly 40 within the roof grooves 37 of respective end panels 22*a*, 22*c* as seen in FIGS. 10 and 11.

Those skilled in the art will recognize that other styles and configurations of the disclosed system 10 can be easily incorporated into the teachings of the present disclosure, and only particular configurations have been shown and described for purposes of clarity and disclosure and not by way of limitation of scope.

The example embodiments of the present invention can be utilized by the common user in a simple and effortless manner with little or no training. After initial purchase or acquisition of the system 10, it would be installed as indicated in FIGS. 1-12.

The method of installing, configuring, and utilizing the system 10 in the playhouse configuration 12 may be achieved by performing the following steps: procuring a model of the system 10 having a desired overall size and preferred external appearance; inserting the sliding doors 34 into the end panel slots 28*a*, 28*b* of the base assembly 20; attaching the first 36*a* and second 36*b* peak panels to top surface portions of respective end panels 22*a*, 22*c* of the base assembly 20 by engaging the peak panel tabs 38 into correspondingly positioned end panel grooves 30; preparing the roof assembly 40 by pivoting adjacent first 42*a* and fourth 42*d* roof panel portions about the second hinge 46*b* into a coplanar relationship; pivoting the adjacent second 42*b* and third 42*c* roof panels about the second hinge 46*b* into a coplanar position; pivoting the half portions of the roof assembly 40 about the center third hinge 46*c* to form an inverted "V"-shape; placing and attaching the inverted "V"-shaped roof assembly 40 upon the subjacent end panels 22*a*, 22*c* and peak panels 36*a*, 36*b* while coincidentally engaging the roof tab portions 44 of the roof assembly 40 and roof groove portions 37 of the peak panels 36*a*, 36*b*; protecting the roof assembly 40 from the elements, if desired, by grasping the pole portion 47 of the cover 50 and extending a distal end portion of the cover 50 outwardly from the cover slot 65; pulling the cover 50 up over the roof assembly 40;

inserting and securing end portions of the pole 47 into the hook brackets 48 located along the first side panel 22*b*; and, pulling the cover 50 taut by rotating the hand crank 62 as needed. The system 10 is now ready for use as a playhouse structure 12. The sliding doors 34 may be motioned horizontally to selectively open or close the entry apertures 27 for entry and exit of users.

The method of configuring and utilizing the system 10 in the table configuration 14 may be achieved by performing the following steps: removing the roof assembly 40 and peak panels 36*a*, 36*b*, if not previously removed; storing the peak panels 36*a*, 36*b* by hanging them upon the end panels 22*a*, 22*c* via engagement of respective cylindrical hanging post 32*b* and hanging aperture 32*a*; folding opposing first 42*a* and second 42*b* roof panels of the roof assembly 40 over upon adjacent fourth 42*d* and third 42*c* roof panels to form a flat narrow table top surface; and, placing the flat roof assembly 40 upon the top surfaces of the end panels 22*a*, 22*c* while coincidentally engaging the roof tabs 44 of the roof assembly 40 and the roof grooves 37 of the end panels 22*a*, 22*c*. Users may now benefit from the table configuration 14 by utilizing the opposing stationary seat portions 23*a*, 23*b* of the base assembly 20, and the flat roof assembly 40 as a table top surface in a similar manner as a conventional picnic table.

It is understood that the modularity of the system 10 may provide other configurations and methods of usage such as, but not limited to: using the base assembly 20 as a base over which a textile tent may be draped and suspended, using the base assembly 20 as a storage device, and the like.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A modular structure comprising:

a base assembly, comprising a pair of seats; and, a roof assembly coupled to said base assembly;

wherein said structure is selectively reconfigurable between a table configuration and a playhouse configuration; and, wherein said seats are exposed by said roof assembly when said structure is in said table configuration and are covered by said roof assembly when said structure is in said playhouse configuration.

2. The structure of claim 1, wherein said roof assembly hingedly connected roof panels, wherein said roof panels are folded in an inverted V-shape configuration to form said playhouse configuration, and wherein said roof panels are folded in a flat configuration to form said table configuration.

3. The structure of claim 1, further comprising a pair of peak panels coupled to said base assembly to form said playhouse configuration, wherein said roof assembly is coupled to said peak panels.

4. The structure of claim 1, further comprising a cover extendable from said base assembly, wherein said cover covers said roof assembly when said structure is in said playhouse configuration.

5. A modular structure comprising:

a base assembly, comprising:

a first end panel comprising a pair of first end panel grooves;

a second end panel opposite said first end panel comprising a pair of second end panel grooves;

a first side panel interconnected between said first end panel and said second end panel; and, a second side panel interconnected between said first end panel and said second end panel opposite said first side panel; and, a roof assembly removably connected to said base assembly, comprising four roof tabs;

wherein said roof assembly is reconfigurable between an inverted V-shape to selectively reconfigure said structure in a playhouse configuration and a flat configuration to selectively reconfigure said structure in a table configuration; and, wherein said roof tabs matingly engage said first end panel grooves and said second end panel grooves to connect said roof assembly to said first end panel and said second end panel when said structure is in said table configuration.

6. The structure of claim 5, further comprising:

a first seat connected to said first side panel; and, a second seat connected to said second side panel;

wherein said first seat and said second seat are exposed by said roof assembly when said structure is in said table configuration; and, wherein said first seat and said second seat are covered by said roof assembly when said structure is in said playhouse configuration.

7. The structure of claim 5, further comprising:

a first peak panel removably connected to said first end panel; and, a second peak panel removably connected to said second end panel;

wherein said roof assembly is removably connected to said first peak panel and said second peak panel when said structure is in said playhouse configuration.

8. The structure of claim 7, wherein:

said first peak panel comprises a pair of first hanging posts;

said second peak panel comprises a pair of second hanging posts;

said first end panel comprises a pair of first hanging apertures;

said second panel comprises a pair of second hanging apertures;

said first hanging apertures receive said first hanging posts to hang said first peak panel on said first end panel when said structure is in said table configuration; and, said second hanging apertures receive said second hanging posts to hang said second peak panel of said second end panel when said structure is in said table configuration.

9. The structure of claim 7, wherein:

said first end panel comprises a pair of first end panel grooves;

said second end panel comprises a pair of second end panel grooves;

said first peak panel comprises a pair of first peak panel tabs;

said second peak panel comprises a pair of second peak panel tabs;

said first peak panel tabs matingly engage said first end panel grooves to connect said first peak panel to said first end panel when said structure is in said playhouse configuration; and, said second peak panel tabs matingly engage said second end panel grooves to connect said second peak panel to said second end panel when said structure is in said playhouse configuration.

10. The structure of claim 7, wherein:

said first peak panel comprises a pair of first roof grooves;

said second peak panel comprises a pair of second roof grooves;

said roof assembly comprises four roof tabs; and, wherein said roof tabs matingly engage said first roof grooves and said second roof grooves to connect said roof assembly to said first peak panel and said second peak panel when said structure is in said playhouse configuration.

11. The structure of claim 5, wherein said base assembly further comprises an entry aperture disposed through at least one of said first end panel and said second end panel.

12. The structure of claim 11, further comprising a pair of sliding doors configured to close said entry aperture.

13. The structure of claim 5, wherein said roof assembly comprises four hingedly connected roof panels arranged in a parallel orientation.

14. The structure of claim 5, further comprising a cover extendable from said base assembly, wherein said cover extends over said roof assembly when said structure is in said playhouse configuration.

15. The structure of claim 14, further comprising a winding assembly configured to store said cover, wherein said winding assembly comprises a spool, and wherein said cover is wound around said spool.

16. The structure of claim 14, further comprising a pair of brackets connected to said base assembly, wherein said cover is removably connected to said brackets to secure said cover over said roof assembly.

17. A modular structure selectively reconfigurable between a table configuration and a playhouse configuration, said structure comprising:

a base assembly comprising:

a first end panel comprising:

a pair of first end panel grooves;

a first entry aperture;

a first end panel slot;

a pair of first sliding doors disposed within said first end panel slot, wherein said first sliding doors are movable to cover said first entry aperture; and, a pair of first hanging apertures;

a second end panel opposite said first end panel, said second end panel comprising:

a pair of second end panel grooves;

a second entry aperture;

a second end panel slot;

a pair of second sliding doors disposed within said second end panel slot, wherein said second sliding doors are movable to cover said second entry aperture; and, a pair of second hanging apertures;

a first side panel interconnected between said first end panel and said second end panel;

a first seat connected to said first side panel, wherein said first seat is exposed when said structure is in said table configuration;

a second side panel interconnected between said first end panel and said second end panel opposite said first side panel, said second side panel comprising a cover slot; and, a second seat connected to said second side panel, wherein said second seat is exposed when in said structure is in said table configuration;

a first peak panel comprising:

a pair of first peak panel tabs, wherein said first peak panel tabs matingly engage said first end panel grooves to connect said first peak panel to said first end panel when said structure is in said playhouse configuration;

a pair of first roof grooves; and, a pair of first hanging posts, wherein said first hanging apertures receive said first hanging posts to hang said first peak panel on said first end panel when said structure is in said table configuration;

a second peak panel comprising:

a pair of second peak panel tabs, wherein said second peak panel tabs matingly engage said second end panel grooves to connect said second peak panel to said second end panel when said structure is in said playhouse configuration;

a pair of second roof grooves; and, a pair of second hanging posts, wherein said second hanging apertures receive said second hanging posts to hang said second peak panel of said second end panel when said structure is in said table configuration;

a roof assembly comprising:

a first roof panel;

a fourth roof panel hingedly connected to said first roof panel;

a third roof panel hingedly connected to said fourth roof panel opposite said first roof panel;

a second roof panel hingedly connected to said third roof panel opposite said fourth roof panel; and, four roof tabs connected to said third roof panel and said fourth roof panel;

wherein said third roof panel and said fourth roof panel are folded at an angle relative to each other, said first roof panel is folded coplanar with said fourth roof panel, and said second roof panel is folded coplanar with said third roof panel to configure said roof assembly into an inverted V-shape when said structure is in said playhouse configuration;

wherein said roof tabs matingly engage said first roof grooves and said second roof grooves to connect said roof assembly to said first peak panel and said second peak panel when said structure is in said playhouse configuration;

wherein said first roof panel is folded onto said first roof panel and said second roof panel is folded onto said third roof panel to configure said roof assembly into a flat shape when said structure is in said table configuration; and, wherein said roof tabs matingly engage said first end panel grooves and said second end panel grooves to connect said roof assembly to said first end panel and said second end panel when said structure is in said table configuration;

an enclosure coupled to an interior surface of said second side panel and said second seat;

a winding assembly disposed within said enclosure and connected to said interior surface of said second side panel, said winding assembly comprising:

a spool bracket connected to said interior surface of said second side panel;

a spool rotatably connected to said spool bracket; and, a crank connected to said spool;

a cover connected to said spool and extendable through said cover slot, said cover comprising a connected to a free end of said cover and located outside said cover slot;

wherein said cover extends over said roof assembly when said structure is in said playhouse configuration, and, wherein said cover is wound around said spool when said structure is in said table configuration; and, a pair of hook brackets connected to an exterior surface of said first side panel opposite said cover slot;

wherein said pole engages said hook brackets to secure said cover over said roof assembly.

* * * * *